US008196653B2

(12) United States Patent
Fripp et al.

(10) Patent No.: US 8,196,653 B2
(45) Date of Patent: Jun. 12, 2012

(54) WELL SCREENS CONSTRUCTED UTILIZING PRE-FORMED ANNULAR ELEMENTS

(75) Inventors: Michael L. Fripp, Carrollton, TX (US); Floyd R. Simonds, Dallas, TX (US); Jean-Marc Lopez, Plano, TX (US); Syed Hamid, Dallas, TX (US); Donald G. Kyle, The Colony, TX (US); Jason Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 214 days.

(21) Appl. No.: 12/419,640

(22) Filed: Apr. 7, 2009

(65) Prior Publication Data

US 2010/0252250 A1 Oct. 7, 2010

(51) Int. Cl.
*E03B 3/18* (2006.01)
*E21B 43/08* (2006.01)

(52) U.S. Cl. ..... 166/235; 166/66; 166/205

(58) Field of Classification Search ..... 166/235, 166/66, 205
See application file for complete search history.

(56) References Cited

U.S. PATENT DOCUMENTS 1,533,747 A * 4/1925 Lough ..... 166/235
1,705,848 A * 3/1929 Austin ..... 166/235
1,709,222 A * 4/1929 Lawlor et al. ..... 166/235
1,995,850 A * 3/1935 Harter ..... 166/235
2,053,856 A * 9/1936 Weidenbacker ..... 210/354
2,314,477 A * 3/1943 Bodey, Jr. ..... 166/234
2,746,552 A * 5/1956 Grospas ..... 166/235
3,009,519 A 11/1961 Brown
3,789,924 A * 2/1974 Aaltonen et al. ..... 166/105.1
3,822,744 A * 7/1974 Reijonen et al. ..... 166/235
4,064,938 A 12/1977 Fast
4,068,713 A 1/1978 McGuire (Continued)

FOREIGN PATENT DOCUMENTS

AU 234285 * 6/1960

(Continued)

OTHER PUBLICATIONS

Arjula, Suresh, and Harsha, A.P., Study of Erosion Efficiency of Polymers and Polymer Composites, article in Polymer Testing publication, Oct. 18, 2005, pp. 188-196, vol. 25, published by Elsevier.

(Continued)

*Primary Examiner* — Jennifer H Gay
(74) *Attorney, Agent, or Firm* — Marlin R. Smith

(57) ABSTRACT

Construction of well screens utilizing pre-formed annular-shaped elements. A well screen includes a filter layer configured to filter fluid flowing through the well screen and a drainage layer which radially supports the filter layer, the drainage layer including multiple individual annular-shaped elements Another well screen includes a drainage layer configured to support the filter layer, with the drainage layer including at least one cavity molded therein. Another well screen includes a base pipe and a layer made up of multiple individual annular-shaped elements stacked coaxially on the base pipe. A cavity is formed in at least one of the elements.

9 Claims, 7 Drawing Sheets

U.S. PATENT DOCUMENTS

| | | | | | |
|---|---|---|---|---|---|
| 4,267,045 | A | * | 5/1981 | Hoof | 210/322 |
| 4,343,358 | A | | 8/1982 | Gryskiewicz | |
| 4,365,669 | A | | 12/1982 | Wagner et al. | |
| 4,378,294 | A | | 3/1983 | Wagner et al. | |
| 4,381,820 | A | | 5/1983 | Wagner | |
| 4,406,326 | A | | 9/1983 | Wagner | |
| 4,428,431 | A | | 1/1984 | Landry et al. | |
| 4,649,996 | A | | 3/1987 | Kojicic et al. | |
| 4,752,394 | A | | 6/1988 | McKenzie et al. | |
| 5,046,892 | A | * | 9/1991 | Kothmann | 405/43 |
| 5,122,271 | A | * | 6/1992 | Simon et al. | 210/314 |
| 5,249,626 | A | | 10/1993 | Gibbins | |
| D365,139 | S | * | 12/1995 | Gibbins | D23/209 |
| 5,785,122 | A | | 7/1998 | Spray | |
| 6,006,829 | A | | 12/1999 | Whitlock et al. | |
| 6,089,316 | A | | 7/2000 | Spray | |
| 6,298,914 | B1 | | 10/2001 | Spray et al. | |
| 6,390,192 | B2 | | 5/2002 | Doesburg et al. | |
| 6,581,683 | B2 | | 6/2003 | Ohanesian | |
| 6,769,484 | B2 | | 8/2004 | Longmore | |
| 7,131,494 | B2 | * | 11/2006 | Bixenman et al. | 166/297 |
| 2002/0053439 | A1 | * | 5/2002 | Danos | 166/380 |
| 2004/0173350 | A1 | * | 9/2004 | Wetzel et al. | 166/253.1 |
| 2005/0279510 | A1 | * | 12/2005 | Patel et al. | 166/380 |
| 2007/0084608 | A1 | * | 4/2007 | Bixenman et al. | 166/380 |
| 2007/0256834 | A1 | * | 11/2007 | Hopkins et al. | 166/278 |
| 2008/0217002 | A1 | | 9/2008 | Simonds et al. | |
| 2010/0252250 | A1 | * | 10/2010 | Fripp et al. | 166/66 |

FOREIGN PATENT DOCUMENTS

| | | | |
|---|---|---|---|
| GB | 565345 | A | 11/1944 |
| WO | 0244522 | A1 | 6/2002 |
| WO | 02055841 | A2 | 7/2002 |
| WO | 2010/036244 | A1 | 4/2010 |

OTHER PUBLICATIONS

Harsha, A.P., Tewari, U.S., and Venkatraman, B., Solid Particle Erosion Behaviour of Various Polyaryletherketone Composites, article in Wear publication, Feb. 5, 2003, pp. 693-712, vol. 254, published by Elsevier.

Barkoula, N.M., Gremmels, J., and Karger-Kocsis, J., Dependence of Solid Particle Erosion on the Cross-link Density in an Epoxy Resin Modified by Hygrothermally Decomposed Polyurethane, article in Wear publication, Sep. 11, 2000, pp. 100-108, vol. 247, published by Elsevier.

International Search Report and Written Opinion issued Oct. 26, 2010, for International Patent Application No. PCT/US2010/029053, 8 pages.

International Preliminary Report on Patentability issued Oct. 20, 2011 for International Patent Application No. PCT/US10/029053, 5 pages.

Office Action issued Jan. 10, 2012 for U.S. Appl. No. 13/267,344, 22 pages.

* cited by examiner

FIG.2
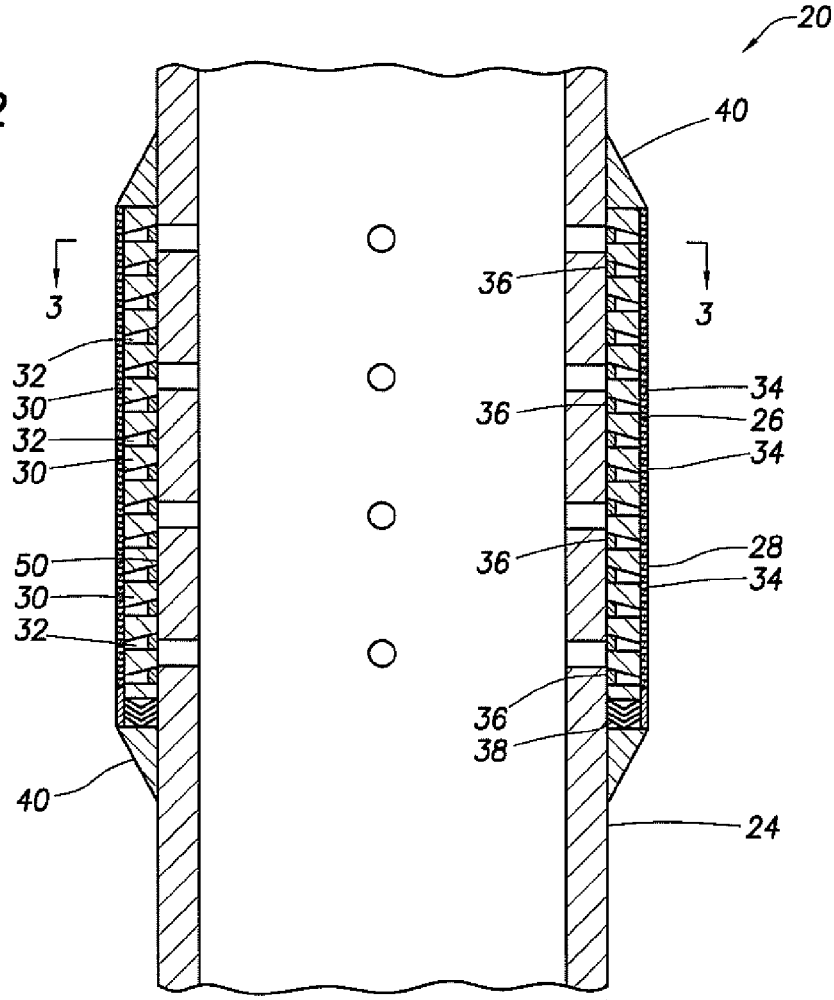
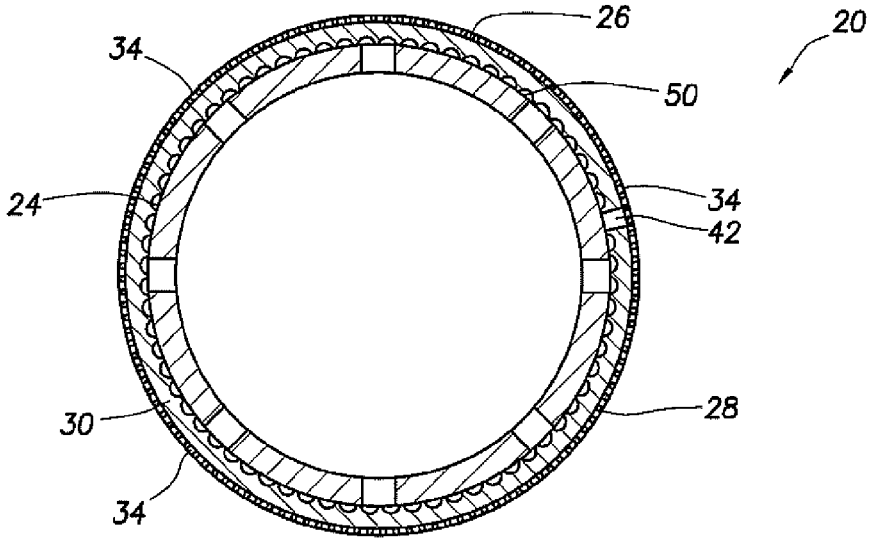
FIG.3

WELL SCREENS CONSTRUCTED UTILIZING PRE-FORMED ANNULAR ELEMENTS

BACKGROUND

This disclosure relates generally to equipment utilized and operations performed in conjunction with a subterranean well and, in an example described below, more particularly provides for construction of well screens utilizing pre-formed annular elements.

Although most well screens perform a relatively simple function (filtering fluid which flows through the side of a tubing string), their design and construction is anything but simple. Very precise tolerances and carefully engineered structural capabilities are needed to enable well screens to exclude exactly the debris which should be excluded, without being overly flow restrictive, and to withstand the rigors of operating in a hostile downhole environment (e.g., conveyance into the well, corrosion, erosion during operation, etc.).

For these reasons (and others, such as, material availability, technical expertise, etc.), most well screens are manufactured in highly specialized factories which, unfortunately, are usually located great distances from where the well screens are to be ultimately installed. As a result, significant delay may be experienced in delivery of well screens to installation locations, local warehouses must be maintained to inventory well screens, custom well screen construction requires substantial advance planning, etc.

Therefore, it will be appreciated that improvements in the art of well screen construction are needed. These improvements would preferably address the problems mentioned above and/or produce other benefits, such as, reduced costs, improved reliability, flexibility of design and construction, etc.

SUMMARY

In the disclosure below, a well screen is provided which solves at least one problem in the art. One example is described below in which a cavity is pre-formed in a layer of the well screen. Another example is described below in which a well screen layer is made up of multiple stacked ring-shaped elements.

In one aspect, a well screen is provided which includes a filter layer configured to filter fluid flowing through the well screen. A drainage layer is configured to support the filter layer. The drainage layer has at least one cavity molded therein.

In another aspect, a well screen is described below which includes a filter layer configured to filter fluid flowing through the well screen and a drainage layer which radially supports the filter layer. The drainage layer includes multiple individual annular-shaped elements.

In yet another aspect, a well screen includes a base pipe and a layer made up of multiple individual annular-shaped elements stacked coaxially on the base pipe. A cavity is formed in at least one of the elements. The layer may be a drainage layer or a filter layer. If the layer is a drainage layer, then it may radially support a filter layer.

The well screen could be used in production or injection operations, or in other types of operations (such as, completion, stimulation, conformance, etc.).

These and other features, advantages and benefits will become apparent to one of ordinary skill in the art upon careful consideration of the detailed description of representative examples below and the accompanying drawings, in which similar elements are indicated in the various figures using the same reference numbers.

BRIEF DESCRIPTION OF THE DRAWINGS

FIG. 2 is an enlarged scale schematic cross-sectional view of a well screen which may be used in the system of FIG. 1, the well screen embodying principles of the present disclosure;

FIG. 3 is a schematic cross-sectional view of the well screen, taken along line 3-3 of FIG. 2;

DETAILED DESCRIPTION

Figure 1:
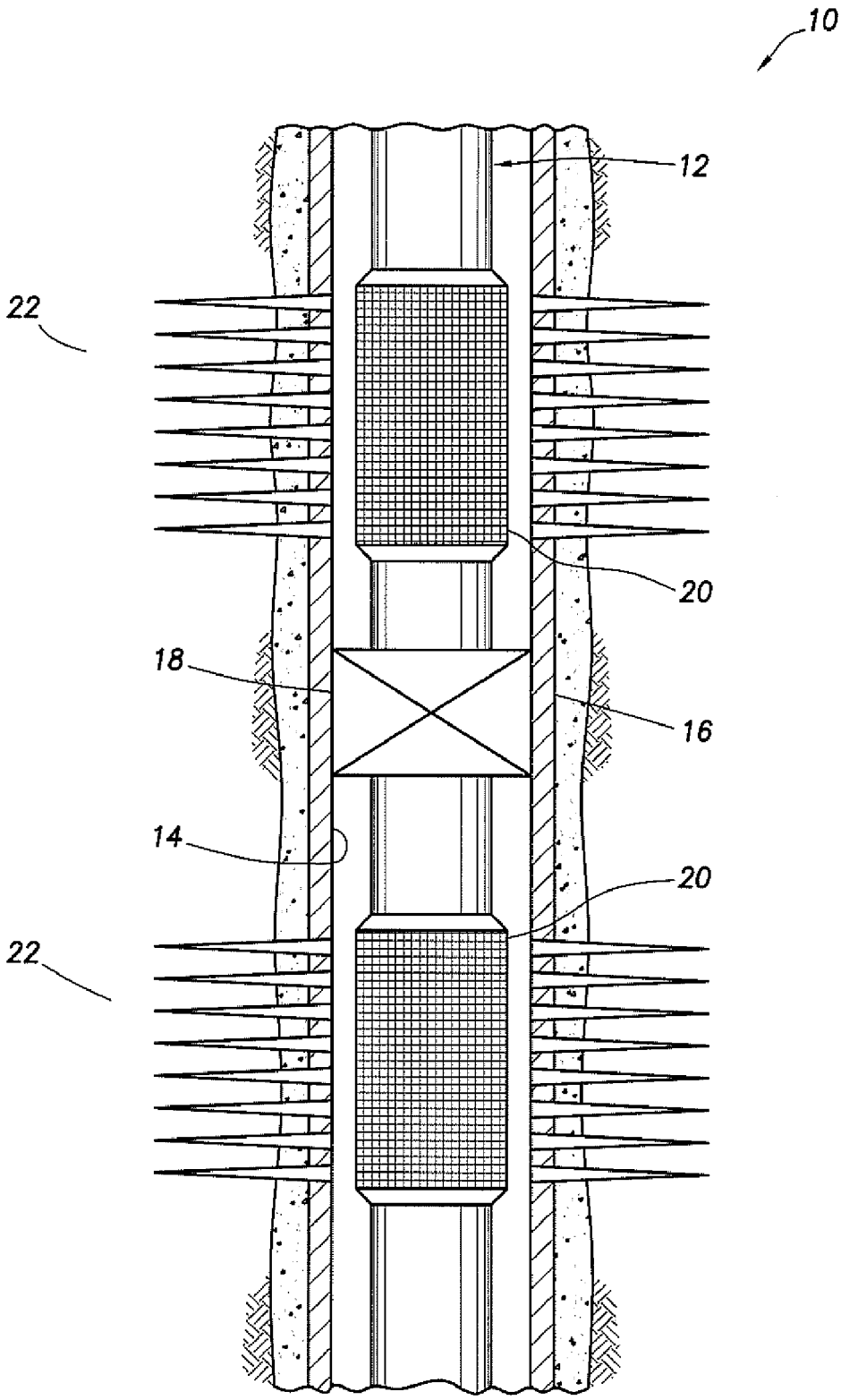
FIG. 1 is a partially cross-sectional view of a well system embodying principles of the present disclosure.

Representatively illustrated in FIG. 1 is a well system 10 which embodies principles of this disclosure. In the system 10, a tubular string 12 has been positioned in a wellbore 14. The wellbore 14 is lined with casing 16. The tubular string 12 includes a packer 18 and multiple well screens 20 for producing fluid from respective multiple zones 22 intersected by the wellbore.

At this point, it should be clearly understood that the well system 10 is described herein as merely one example of a wide variety of well systems which can incorporate the principles of this disclosure. For example, it is not necessary for the wellbore 14 to be vertical (the wellbore could instead be horizontal or inclined), and it is not necessary for the wellbore to be cased (e.g., the wellbore could be open hole or uncased adjacent the well screens 20 and/or packer 18). Any number of well screens 20 could be used for production from, or injection into, any number of zones 22. Thus, it should be appreciated that the principles of this disclosure are not limited in any manner to the details of the system 10 described herein.

One unique feature of the system 10 is that it includes the well screens 20 which are themselves uniquely configured to, for example, reduce costs of manufacturing, enable manufacture at diverse locations, ease assembly, provide for ready customization, and/or to allow for enhanced capabilities (such as incorporated sensing, telemetry, inflow control, etc.) in a convenient manner. Other capabilities and features can be included in the well screens 20 in keeping with the principles of this disclosure.

Referring additionally now to FIGS. 2 & 3, cross-sectional views of the well screen 20 are representatively illustrated. In these views it may be seen that the well screen 20 includes a generally tubular perforated base pipe 24 on which a drainage layer 26 and a filter layer 28 are radially outwardly disposed. The base pipe 24 is preferably provided with suitable end connections (such as threaded ends, not shown) for interconnection of the well screen 20 in the tubular string 12 in the system 10. Of course, the well screen 20 can be used in other well systems, without departing from the principles of this disclosure.

The filter layer 28 is configured to filter fluid flowing into the well screen 20. The drainage layer 26 is configured to radially outwardly support the filter layer 28, so that fluid can readily flow through the filter layer and into the base pipe 24.

Of course, the drainage and filter layers 26, 28 can perform other functions in keeping with the principles of this disclosure. The drainage and filter layers 26, 28 could also be otherwise positioned, for example, with the drainage layer inwardly supporting the filter layer, if desired.

The filter layer 28 may be made of any type of material. For example, wire wraps, sintered metal, wire mesh, etc., are suitable for use in the filter layer 28. Materials such as metals, plastics and composites may be used, as well.

The drainage layer 26 may also be made of any type of material. Preferably, the drainage layer 26 is made up of stacked annular-shaped elements 30. These elements 30 are preferably made of molded plastic (such as injection molded phenolic or other thermoset plastic, polyetheretherketone, polyetherimide, polyphenylene sulfide, etc.).

However, other materials (such as cast metal, etc.) may be used if desired. Other manufacturing methods (such as stamping, etc.) could also be used if desired.

Furthermore, fillers or fibers could be added to a plastic matrix to form a composite structure for the elements 30. As another alternative, a layered material (for example, a base of a relatively inexpensive tough material, such as plastic, with a coating or outer layer of erosion-resistant and/or corrosion-resistant material, such as metal) may be used for the elements 30, if desired.

Since the drainage layer 26 is not normally intended for filtering the fluid flowing radially through the well screen 20, passages 32 formed axially between the elements 30 are preferably larger than passages 34 for flow through the filter layer 28, that is, the passages 32 have a greater minimum dimension than the passages 34. However, the passages 32 in the drainage layer 26 could have substantially the same minimum dimension as the passages 34 in keeping with the principles of this disclosure.

Although only the two layers 26, 28 are depicted in FIGS. 2 & 3, it should be understood that any number of layers could be provided, as desired. For example, another filter layer or an outer shroud could be positioned external to the filter layer 28, another drainage layer could be positioned internal to the drainage layer 26, etc. Thus, it should be clearly understood that the principles of this disclosure are not limited at all to the details of the well screen 20 as depicted in FIGS. 2 & 3.

The elements 30 of the drainage layer 26 are axially stacked on the exterior of the base pipe 24, but the passages 32 are formed axially between the elements due to protrusions 36 extending outwardly from each element. A biasing device 38 (such as a compression or wave spring) maintains axial compression on the stack of elements 30, so that the axial spacing of the elements remains consistent.

End rings 40 may be used to secure the layers 26, 28 on the base pipe 24, and to retain the biasing device 38. Alternatively, the ends of the layers 26, 28 could be crimped onto the base pipe 24, for example, as described in U.S. application Ser. No. 12/166,966 filed on Jul. 2, 2008, the entire disclosure of which is incorporated herein by this reference.

As depicted in FIG. 3, the elements 30 may be provided with circumferential gaps 42. This allows the elements 30 to be somewhat resilient or adjustable in circumference to accommodate variations in diameter of the base pipe 24.

Thus, it will be readily appreciated that the features of the well screen 20 described above allow the well screen to be readily assembled and customized as needed at various locations by persons requiring relatively little training. For example, various lengths of well screen 20 may be assembled conveniently by merely varying the number of elements 30 stacked onto an appropriate length of base pipe 24, with an appropriate length of filter layer 28 installed thereon. Locally-sourced base pipe 24 can be used, with variations in outer diameter being accommodated by the elements 30. As such, the well screen 20 does not require a highly specialized manufacturing facility, but can instead be assembled at any of many locations in virtually any part of the world.

Figure 4:
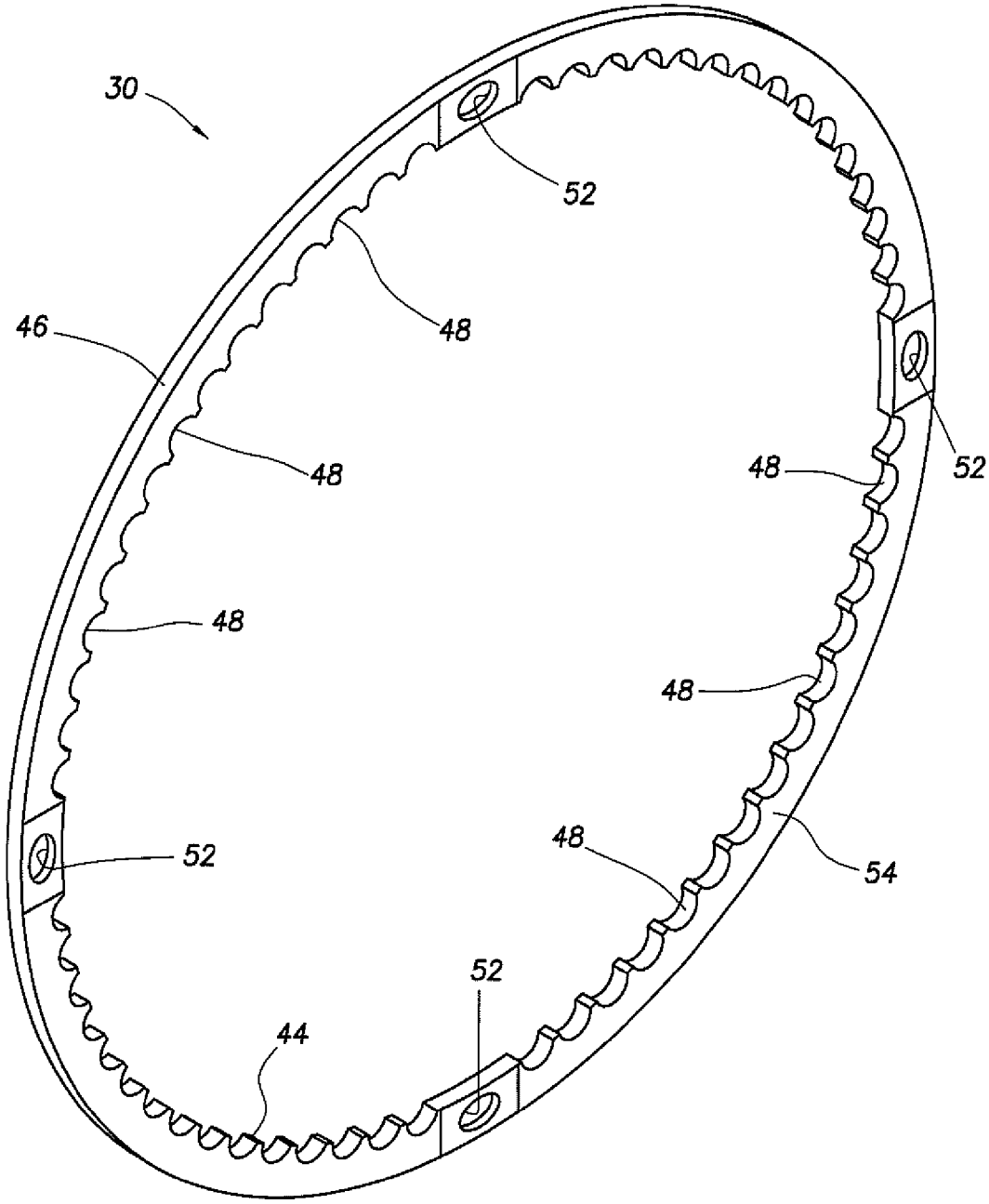
FIG. 4 is an enlarged scale schematic isometric view of an annular-shaped element of the well screen.

Referring additionally now to FIG. 4, another configuration of the element 30 is representatively illustrated. Although not depicted as so in FIG. 4, the element 30 could have the circumferential gap 42 therein, if desired.

However, preferably the gap 42 is not used. For example, other means may be used to accommodate varying outer diameters of the base pipe 24, other means may be used to provide for varying the circumferential length of the element 30, etc.

In FIG. 4 it may be seen that the element 30 includes inner and outer surfaces 44, 46. The inner surface 44 is scalloped, with recesses 48 formed thereon to permit fluid flow longitudinally along an outer surface 50 of the base pipe 24 (see FIGS. 2 & 3), i.e., between the drainage layer 26 and the base pipe. The outer surface 46 could also be provided with scallops, undulations, recesses, etc., if desired, to provide for enhanced longitudinal fluid flow between the drainage and filter layers 26, 28.

In FIG. 4 it may also be seen that recesses 52 are formed in a side surface 54 of the element 30. These recesses 52 provide for accurate alignment and spacing of the elements 30 on the base pipe 24, as described more fully below.

Figure 5:
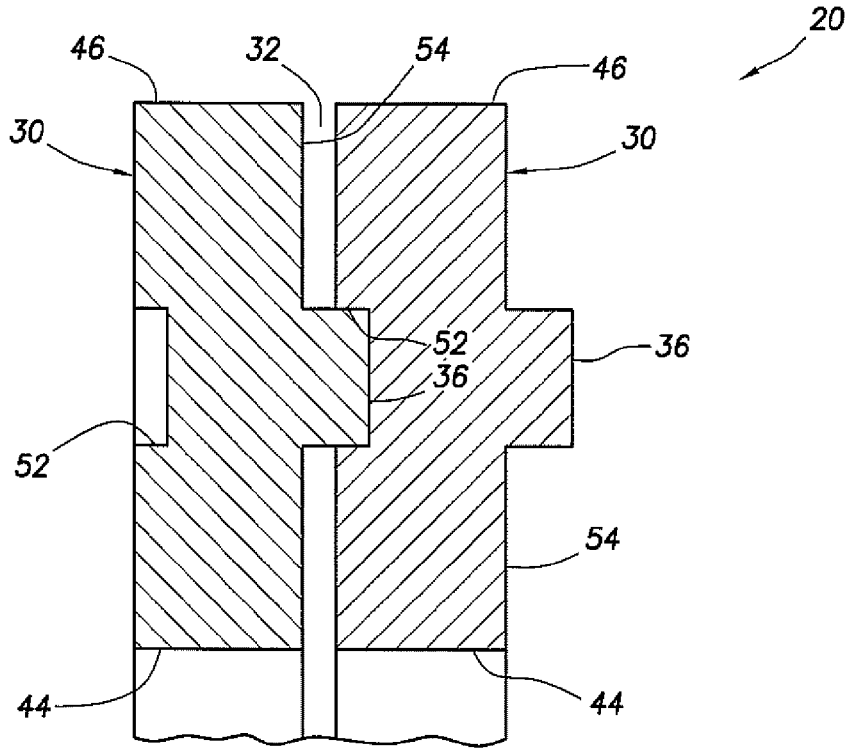
FIG. 5 is a further enlarged scale schematic cross-sectional view of stacked multiple elements.

Referring additionally now to FIG. 5, two of the elements 30 are representatively illustrated in a cross-sectional view, apart from the remainder of the well screen 20. In this view it may be seen that the protrusions 36 cooperatively engage the recesses 52 between the adjacent pair of the elements 30.

Several benefits are derived by this engagement between the protrusions 36 and the recesses 52. One benefit is that the elements 30 are accurately spaced, with the passage 32 for fluid flow between the elements being determined by the difference between the length of the protrusions 36 and the depth of the recesses 52. Thus, by merely providing varied length protrusions 36 and/or varied depth recesses 52, the minimum dimension of the passages 32 can be conveniently varied, as desired.

Another benefit is that the engagement between the protrusions 36 and recesses 52 provides circumferential alignment of the adjacent elements 30. This alignment can be used to enable installation and accommodation of conduits, lines, sensors, etc. in the elements 30, as described more fully below.

Other methods of engagement are also possible, such as, snaps, clips, etc. Thus, the protrusion 36/recess 52 engagement could also provide a locking engagement, as well as spacing apart and circumferentially aligning the elements 30.

Note that the recesses 52 are not necessary to space the elements 30 apart and form the passages 32. Instead, only the protrusions 36 could be used for this purpose. Furthermore, the protrusions 36 could be other structural features used to space apart the elements 30, such as, separate spacers, undulations in the elements, features on the base pipe 24 or filter layer 28, etc.

Figure 6:
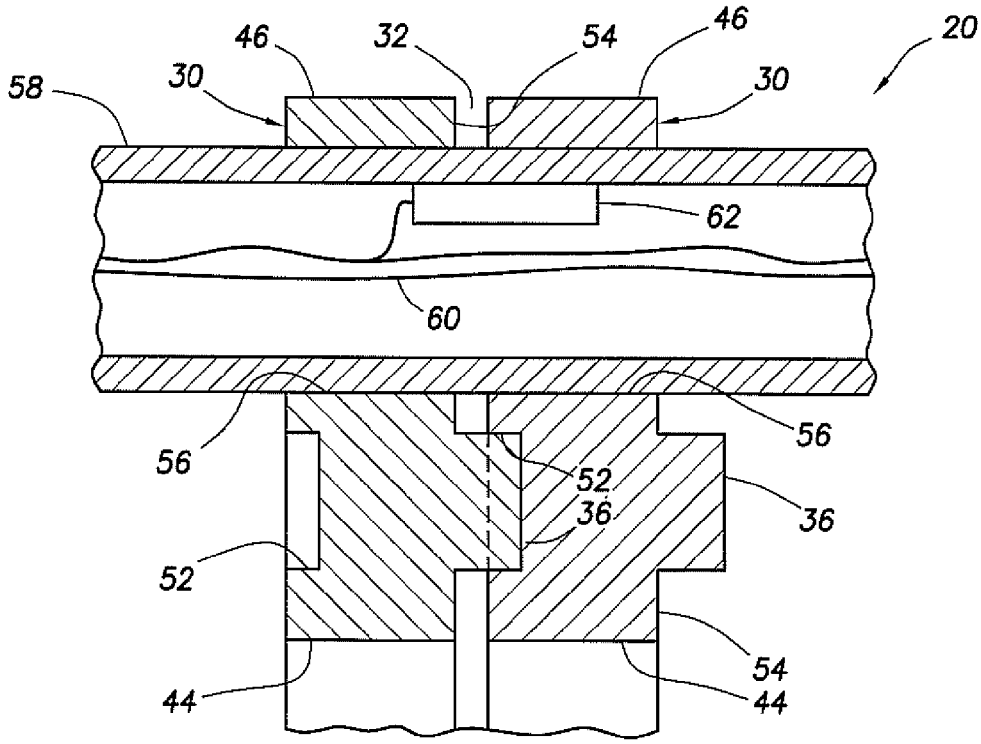
FIG. 6 is a schematic cross-sectional view of a conduit, lines and sensor extending through cavities in the elements.

Referring additionally now to FIG. 6, another configuration of the well screen 20 is representatively illustrated. In this configuration, the protrusions 36 and recesses 52 are positioned on the elements 30 closer to the inner surfaces 44, and each element is provided with a cavity 56 formed therein.

The cavities 56 are aligned with each other due to the engagement between the protrusions 36 and recesses 52 in this example. However, in other examples, a conduit 58 or other member extending through the cavities 56 could be used to align the cavities with each other, whether or not the protrusions 36 and/or recesses 52 are used.

The conduit 58 can serve as a fluid line, for example to hydraulically or pneumatically operate various well tools, sense downhole parameters, or for any other purpose. The conduit 58 can serve as a shunt tube for flowing a slurry across the well screen 20 during a gravel packing operation. The conduit 58 can serve any other purpose, as well, in keeping with the principles of this disclosure.

As depicted in FIG. 6, the conduit 58 serves to contain and protect various lines 60 extending through the conduit. The lines 60 could include, for example, fluid lines, electrical lines, optical waveguides (such as fiber optic lines), etc., for providing power, communication, data, command, control or property sensing functions (e.g., an optical fiber can serve as a temperature and/or pressure sensor, transmit optical power, provide a communication link, etc.).

In addition, a sensor 62 is illustrated in FIG. 6 as being positioned within the conduit 58 in the cavities 56. The sensor 62 could be any type of sensor, such as a temperature, pressure, telemetry, electromagnetic, acoustic, density, water cut, flow rate, radioactivity, etc., sensor. As discussed above, any of the lines 60 could also serve as a sensor.

It will be appreciated that, if the cavities 56 are pre-formed in the elements 30, installation of the conduit 58, lines 60, sensor 62 and/or other components is made much more convenient. Preferably, the elements 30 are preferably molded with the cavities 56 therein, so that assembly of the well screen 20 is expedited and the overall cost of the well screen is reduced. Note that the cavities 56 may be used to accommodate components other than the conduit 58, lines 60 and sensor 62, as described more fully below.

Figure 7:
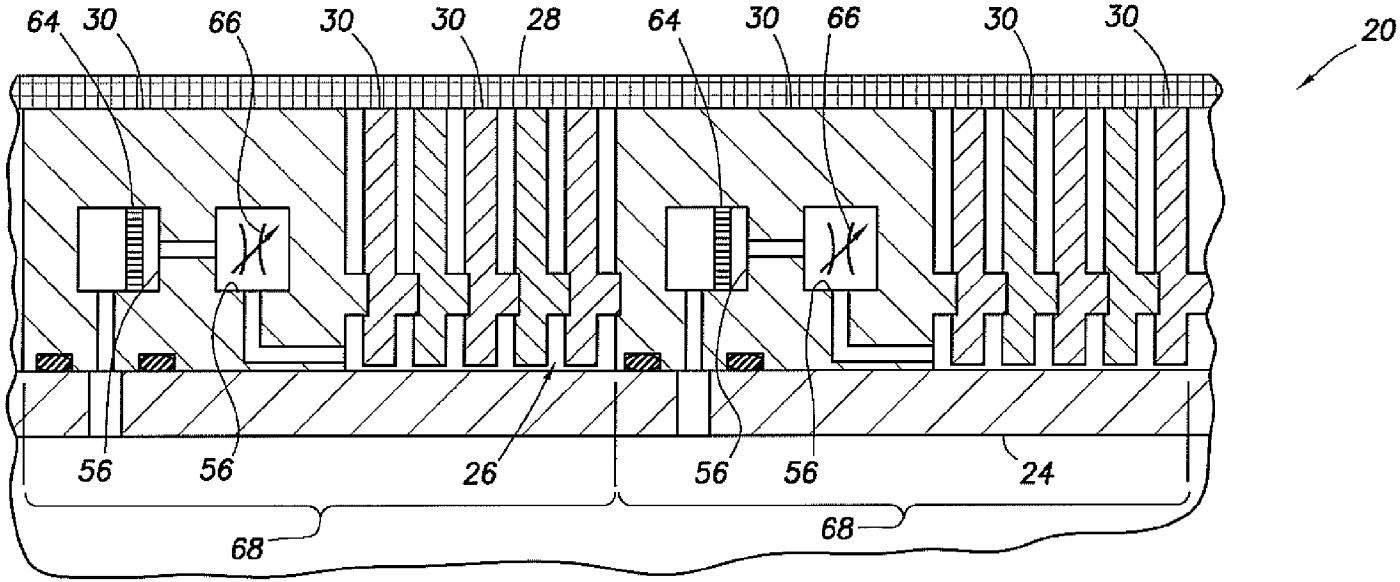
FIG. 7 is a somewhat reduced scale schematic cross-sectional view of another configuration of the well screen, including inflow control devices in element cavities.

Referring additionally now to FIG. 7, another configuration of the well screen 20 is representatively illustrated. In this configuration, the cavities 56 in certain ones of the elements 30 are used to contain inflow control devices 64, 66. However, only certain ones of the elements 30 are provided with the cavities 56 and inflow control devices 64, 66.

As depicted in FIG. 7, the inflow control device 64 is of the type used to reduce production of undesired fluid (such as water or gas). The inflow control device 66 is of the type used to variably restrict flow of fluid into the well screen 20.

The inflow control devices 64, 66 may be used to control relative production from the zones 22 in the well system 10, for example, to reduce or eliminate water or gas coning. Suitable inflow control devices are described in U.S. Pat. Nos. 7,469,743 and 7,185,706, and in U.S. application Ser. No. 11/407,848 filed Apr. 20, 2006 and Ser. No. 11/671,319 filed Feb. 5, 2007. The entire disclosures of these prior patents and applications are incorporated herein by this reference. Other types of inflow control devices may be used, if desired.

Note that the elements 30 containing the inflow control devices 64, 66 are included in respective separate sets 68 of the elements spaced along the base pipe 24. In this manner, each of the elements 30 having the inflow control devices 64, 66 therein can separately regulate flow of fluid through the respective set 68, enabling much finer resolution of flow regulation along the tubular string 12 than previously possible.

For example, instead of flow through an entire 10 meter length well screen being regulated via a single inflow control device as in the past, the well screen 20 of FIG. 7 can provide for independent flow regulation every half meter increment along its length. Of course, other spacings of the inflow control devices 64, 66 can be used, if desired (including only one inflow control device per well screen 20).

Figure 8:
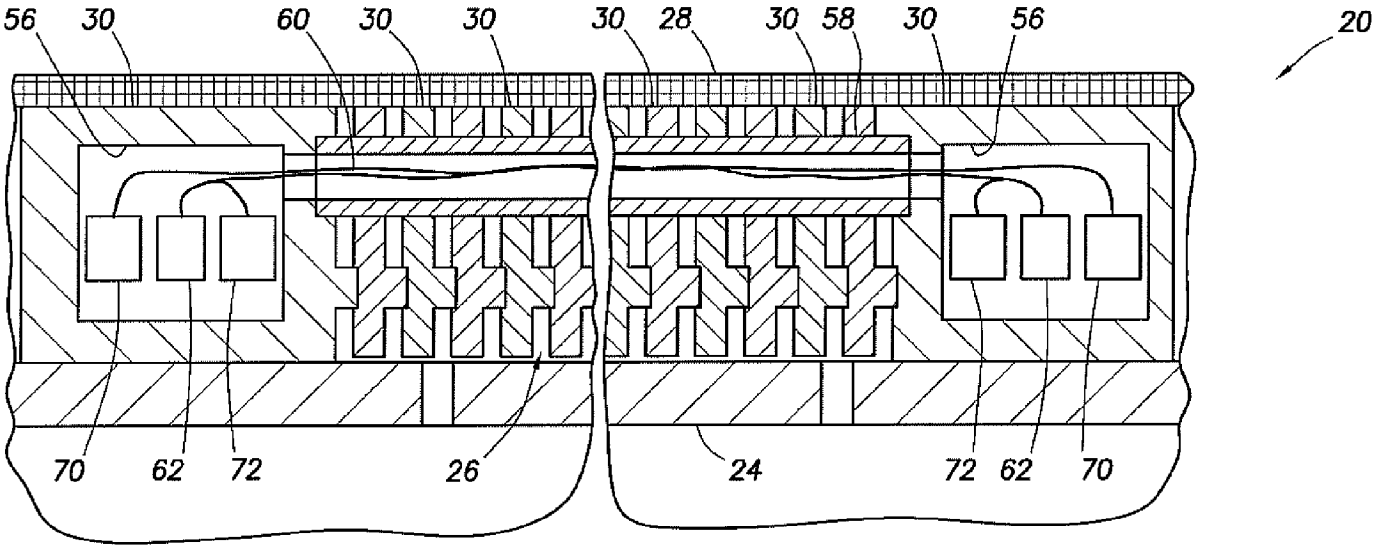
FIG. 8 is a schematic cross-sectional view of another configuration of the well screen, including telemetry devices in element cavities.

Referring additionally now to FIG. 8, another configuration of the well screen 20 is representatively illustrated. In this configuration, certain ones of the elements 30 are provided with cavities 56 which contain telemetry devices 70, such as an acoustic, electromagnetic, pressure pulse, inductive coupling, or other type of telemetry transmitter, receiver or transceiver. Sensors 62 may also be contained in the cavities 56, along with power sources 72, such as batteries or generators, etc.

The conduit 58 and/or lines 60 may be used to interconnect the telemetry devices 70, sensors 62 and/or power sources 72 along the well screen 20. The telemetry devices 70 may be positioned near ends of the well screen 20 to provide for communication between adjacent or spaced apart well screens, as described more fully below.

Figure 9:
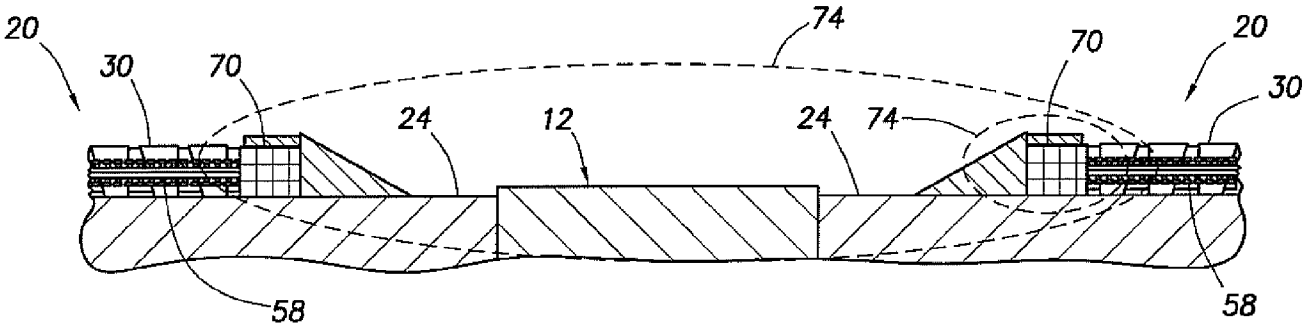
FIGS. 9-11 are somewhat reduced scale schematic partially cross-sectional views of various telemetry techniques for communicating between well screens.
Figure 10:
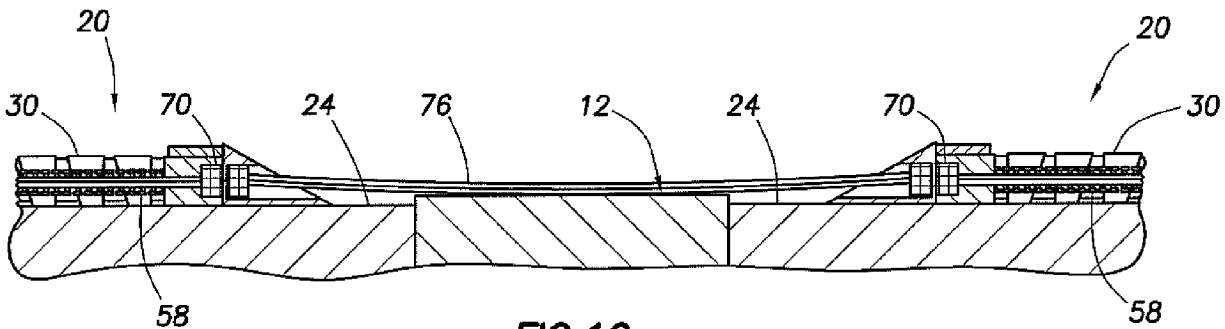
Figure 11:
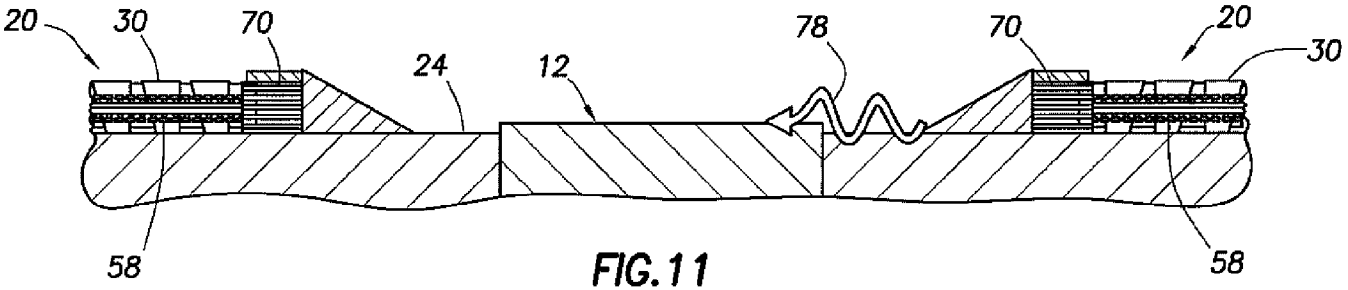

Referring additionally now to FIGS. 9-11, various forms of telemetry between well screens 20 are representatively illustrated. In FIG. 9, the telemetry devices 70 comprise wire coils which are used to propagate magnetic flux lines 74 from one well screen 20 to another, to thereby transmit information such as data, commands, etc. Each device 70 can serve as a transmitter and/or receiver.

In FIG. 10, the telemetry devices 70 comprise inductive couplings with an electrical conductor 76 extending between the couplings. In this manner, the well screens 20 can be conveniently installed and connected to each other for communication between the well screens.

In FIG. 11, the telemetry devices 70 comprise acoustic signal transmitters and receivers. The tubular string 12 serves as a transmission medium for acoustic waves 78 propagated from one well screen 20 to another.

Note that, in FIGS. 9-11, the telemetry devices 70 are not depicted as being contained in the cavities 56 in the elements 30, but the telemetry devices could be positioned in the cavities if desired, as depicted in FIG. 8.

Figure 12:
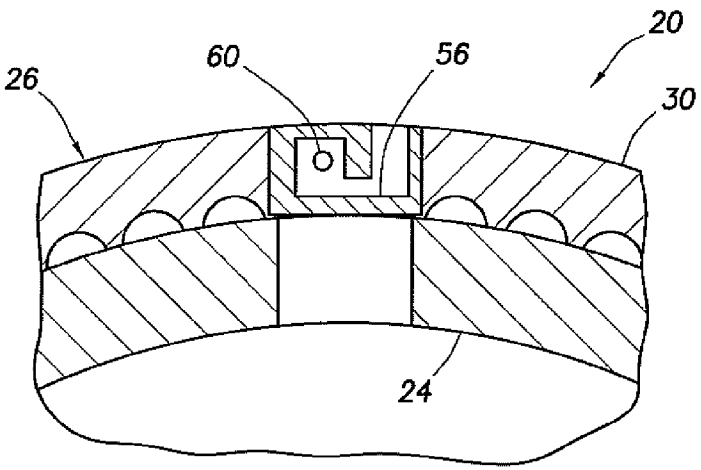
FIG. 12 is a schematic partially cross-sectional view of another configuration of the well screen, including a convenient line installation.

Referring additionally now to FIG. 12, another configuration of the well screen 20 is representatively illustrated. In this configuration, the cavities 56 provide for convenient installation of the lines 60 in the elements 30, in that the cavities are J-shaped. The cavities 56 could be otherwise-shaped, such as keyhole or T-shaped, etc., if desired.

The direction of the J-shape can be alternated along the length of the well screen 20, so that the lines 60 are retained in the cavities 56 without need for any additional retainer or closure. However, a separate retainer or closure could be used, if desired. In addition, the lines 60 could be contained in the conduit 58 in the cavities 56, if desired.

The configuration of FIG. 12 permits the lines 60 to be installed in the elements 30 from the exterior thereof, even while the well screen 20 is being conveyed into the well. Alternatively, the lines 60 could be installed in the cavities 56 during assembly of the well screen 20.

Note that the layer 26 is depicted in FIG. 12 without the filter layer 28 on an exterior thereof. This demonstrates that the layer 26 can serve as a filter layer, if desired. For example, the passages 32 between elements 30 could be used to filter fluid flowing into the well screen 20.

However, the separate filter layer 28 can be used on the configuration of FIG. 12 in keeping with the principles of this disclosure. For example, the filter layer 28 could be installed on the layer 26 after the line 60 and/or conduit 58 is installed in the cavities 56.

Figure 13:
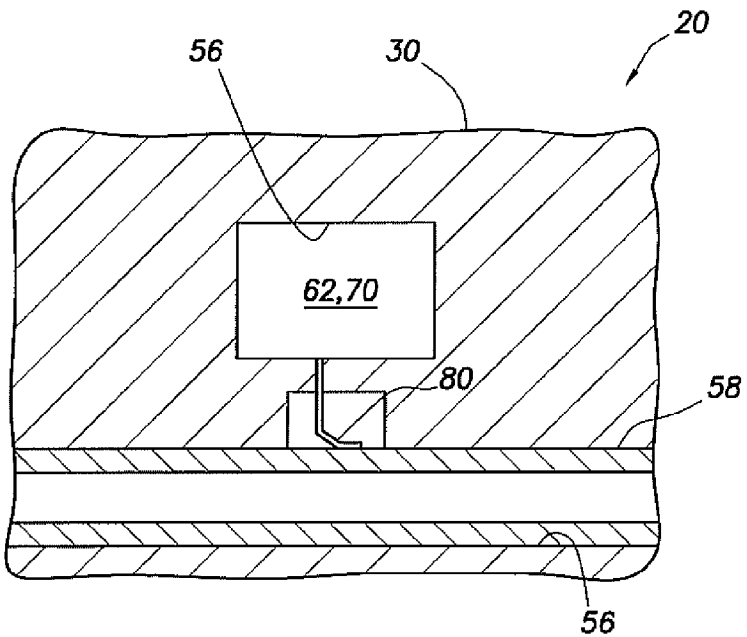
FIG. 13 is a schematic partially cross-sectional view of another configuration of the well screen, including a convenient connection to a device, such as a sensor or telemetry device.

Referring additionally now to FIG. 13, another configuration of the well screen 20 is representatively illustrated. In this configuration, the conduit 58 is used to electrically connect with the sensor 62 and/or telemetry device 70 in a cavity 56 of an element 30.

As depicted in FIG. 13, an electrical spring contact 80 is connected to the sensor 62 and/or telemetry device 70 in the element 30. When the conduit 58 is installed into the element 30, the conduit engages the contact 80, thereby making an electrical connection with the sensor 62 and/or telemetry device 70. It is beneficial, in this configuration, for the element 30 to be made of an electrically insulative material (such as plastic, etc.).

In each of the embodiments described above, the elements 30 could be made in any length. For example, a relatively long element 30 could have multiple passages 32 formed therein, and multiple such long elements could be connected together, so that the passages 32 are not necessarily formed only by spacing apart the elements.

It may now be fully appreciated that the above disclosure provides many improvements to the art of well screen construction. Preferably, the described well screen 20 includes pre-formed (e.g., molded, extruded, cast, etc.) elements 30 which enable convenient, versatile and cost effective construction of the well screen, without requiring highly specialized assembly facilities and highly trained assembly personnel.

The above disclosure describes a well screen 20 which includes a filter layer 28 configured to filter fluid flowing through the well screen 20, and a drainage layer 26 configured to support the filter layer 28. The drainage layer 26 includes at least one cavity 56 molded therein.

The drainage layer 26 may include multiple individual annular-shaped elements 30. The cavity 56 may be molded in at least one of the elements 30.

A conduit 58 may extend through a plurality of the elements 30.

At least one line 60 may extend through a plurality of the elements 30. The line 60 may comprise at least one of an optical waveguide, an electrical line and a fluid line.

The elements 30 may be spaced apart from each other by at least one protrusion 36 formed on one or more of the elements 30. Each of the protrusions 36 may engage a respective recess 52 formed on an adjacent one of the elements 30, thereby circumferentially aligning the elements 30. The cavity 56 may be formed in the elements 30, such that circumferential alignment of the elements 30 by the protrusions 36 and recesses 52 also aligns the cavities 56 with each other.

The drainage layer 26 may be made of an electrically insulative material. The drainage layer 26 may have a greater minimum flow passage 32 dimension than the filter layer 28 (passages 34).

The well screen 20 may also include at least one of a sensor 62, a telemetry device 70 and an inflow control device 64, 66, positioned at least partially in the cavity 56.

Also provided by the above disclosure is a well screen 20 which combines a filter layer 28 configured to filter fluid flowing through the well screen 20 and a drainage layer 26 which radially supports the filter layer 28. The drainage layer 26 includes multiple individual annular-shaped elements 30.

Each of the elements 30 may include a cavity 56 formed therein, and the cavities 56 may be aligned with each other. The cavities 56 may be aligned by complementary protrusions 36 and recesses 52 formed on the elements 30. The protrusions 36 may space apart the elements 30, so that flow passages 32 are formed between the elements 30.

The well screen 20 may also include a conduit 58 extending through the aligned cavities 56. The well screen 20 may include at least one of an optical waveguide, an electrical line and a fluid line 60 extending through the aligned cavities 56.

The cavities 56 can comprise recesses 48 formed on an inner surface 44 of each of the elements 30. The recesses 48 may provide for longitudinal flow of fluid along an outer surface 50 of a base pipe 24 which extends through the elements 30.

The well screen 20 may include a cavity 56 molded in at least one of the elements 30. At least one of a sensor 62, a telemetry device 70 and an inflow control device 64, 66 may be positioned at least partially in the cavity 56.

The elements 30 may be made of an electrically insulative material.

Inflow control devices 64, 66 may be positioned in respective cavities 56 formed in respective ones of the elements 30. The inflow control devices 64, 66 may receive fluid flow from respective spaced apart sets 68 of the elements 30.

The elements 30 may be made of a material which comprises a thermoset plastic.

Also described above is a well screen 20 which combines a base pipe 24 and a layer 26 made up of multiple individual annular-shaped elements 30 stacked coaxially on the base pipe 24. A cavity 56 is formed in at least one of the elements 30.

The cavity 56 may be formed in the elements 30, whereby the layer 26 includes multiple cavities 56. The cavities 56 may be aligned with each other.

The cavities 56 may be aligned by complementary protrusions 36 and recesses 52 formed on the elements 30. The protrusions 36 may space apart the elements 30, so that flow passages 32 are formed between the elements 30.

A conduit 58 may extend through the aligned cavities 56. At least one of an optical waveguide, an electrical line and a fluid line 60 may extend through the aligned cavities 56.

The cavities 56 may comprise recesses 48 formed on an inner surface 44 of each of the elements 30, and the recesses 48 may provide for longitudinal flow of fluid along an outer surface 50 of the base pipe 24.

The well screen 20 may include at least one of a sensor 62, a telemetry device 70 and an inflow control device 64, 66, positioned at least partially in the cavity 56.

The cavity 56 may be disposed between inner and outer surfaces 44, 46 of at least one of the elements 30.

The first layer 26 may support a second layer 28 which is configured to filter fluid flowing into the well screen 20, with the first layer 26 being positioned between the second layer 28 and the base pipe 24.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well screen, comprising:

a filter layer which filters fluid flowing through the well screen;

a drainage layer which supports the filter layer, wherein the drainage layer includes multiple individual annular-shaped elements; and a base pipe which supports the drainage layer, wherein the drainage layer has at least one cavity formed therein, wherein the cavity comprises a recess in an outer surface of the drainage layer, and wherein the cavity is formed in at least one of the elements.

2. The well screen of claim 1, wherein a conduit extends through a plurality of the elements.

3. The well screen of claim 1, wherein at least one line extends through a plurality of the elements, the line being selected from the group consisting of an optical waveguide, an electrical line and a fluid line.

4. The well screen of claim 1, wherein the elements are spaced apart from each other by at least one protrusion formed on at least one of the elements.

5. The well screen of claim 4, wherein the at least one protrusion engages a respective recess formed on an adjacent one of the elements, thereby circumferentially aligning the elements.

6. The well screen of claim 5, wherein circumferential alignment of the elements also aligns the cavity formed in at least one of the elements with another cavity formed in the adjacent one of the elements.

7. The well screen of claim 1, wherein the drainage layer has a greater minimum flow passage dimension than the filter layer.

8. The well screen of claim 1, further comprising at least one of a sensor, a telemetry device and an inflow control device, positioned at least partially in the cavity.

9. A well screen, comprising:

a filter layer which filters fluid flowing through the well screen;

a drainage layer which supports the filter layer; and a base pipe which supports the drainage layer, wherein the drainage layer has at least one cavity formed therein, wherein the cavity comprises a recess in an outer surface of the drainage layer, the recess extending only partly through the drainage layer, and wherein the drainage layer is made of an electrically insulative material.

* * * * *